US005153435A

United States Patent [19]

Greene

[11] Patent Number: 5,153,435

[45] Date of Patent: Oct. 6, 1992

[54] PLANAR SCOROTRON DEVICE

[75] Inventor: Nathaniel R. Greene, Lexington, Mass.

[73] Assignee: Xerox Corporation, Stamford, Conn.

[21] Appl. No.: 697,541

[22] Filed: May 9, 1991

[51] Int. Cl.[5] ..... H01T 19/04

[52] U.S. Cl. ..... 250/326; 361/229; 346/159

[58] Field of Search ..... 250/324, 325, 326; 361/229; 346/159

[56] References Cited

U.S. PATENT DOCUMENTS

| | | | |
|---|---|---|---|
| 2,588,699 | 3/1952 | Carlson | 95/1.9 |
| 2,777,957 | 1/1957 | Walkup | 250/49.5 |
| 2,932,742 | 4/1960 | Ebert | 250/49.5 |
| 3,877,038 | 4/1975 | Krekow et al. | 346/159 |
| 4,086,650 | 4/1978 | Davis et al. | 361/229 |
| 4,425,035 | 1/1984 | Tarumi et al. | 355/3 CH |
| 4,426,654 | 1/1984 | Tarumi et al. | 250/326 |
| 4,562,447 | 12/1985 | Tarumi et al. | 346/159 |
| 4,794,254 | 12/1988 | Genovese et al. | 250/326 |
| 4,841,146 | 6/1989 | Gundlach et al. | 250/324 |
| 4,963,738 | 10/1990 | Gundlach et al. | 250/326 |
| 4,990,942 | 2/1991 | Therrien et al. | 346/159 |

*Primary Examiner*—Bruce C. Anderson

*Attorney, Agent, or Firm*—William A. Henry, II

[57] ABSTRACT

A planar ion source, charging device includes a resistive comb pattern on a rigid planar dielectric support with the comb pattern extending to the edge(s) of one or more slots through the dielectric support.

20 Claims, 3 Drawing Sheets

PLANAR SCOROTRON DEVICE

This invention relates to a scorotron charging device, and more particularly, to a rigid, planar scorotron device that applies a uniform charge to a charge retentive surface.

Corona charging of xerographic photoreceptors has been disclosed as early as U.S. Pat. No. 2,588,699. It has always been a problem that current levels for practical charging require coronode potentials of many thousands of volts, while photoreceptors typically cannot support more than 1000 volts surface potential without dielectric breakdown.

One attempt at controlling the uniformity and magnitude of corona charging is U.S. Pat. No. 2,777,957 which makes use of an open screen as a control electrode, to establish a reference potential, so that when the receiver surface reaches the screen voltage, the fields no longer drive ions to the receiver, but rather to the screen. Unfortunately, a low porosity screen intercepts most of the ions, allowing a very small percentage to reach the intended receiver. A more open screen, on the other hand, delivers charges to the receiver more efficiently, but compromises the control function of the device.

Other methods exist for trying to obtain uniform charging from negative charging systems such as dicorotron charging devices as shown in U.S. Pat. No. 4,086,650 that include glass coated wires and large specialized AC power supplies.

Devices for modulating ions include U.S. Pat. Nos. 4,425,035 and 4,562,447 which disclose an ion modulating electrode for an electrostatic recording apparatus. The ion modulating electrode includes a continuous layer of conductive material and a segmented layer of conductive material separated from each other by an insulating layer. The insulating layer includes a plurality of apertures, which may be bored by a laser beam, through which the ions flow. U.S. Pat. No. 2,932,742 discloses an apparatus for charging a xerographic plate and has a screen electrode consisting of alternating conductive areas having open spaces therebetween. U.S. Pat. No. 4,841,146 is directed to a self cleaning charging unit that includes an insulating housing and a current limited, low capacitance corona wire positioned within the housing and located 0.5–6 mm away from biased conductive plates which form a slit through the bottom of the housing that allows ions to pass therethrough onto a receptor surface. These devices have not been entirely satisfactory since some of these are costly, while others are difficult to fabricate and most are inefficient.

A scorotron charging device that meets some of the above deficiencies is U.S. Pat. No. 4,963,738 which is directed to a charging device having a coronode that includes a comb-like ruthenium glass electrode silk screened onto a supporting dielectric substrate. The teeth of the comb-like electrode extend to an edge of the dielectric substrate and positionable relative to a screen or slit in order to form a scorotron. But, the problem with this unit is that it requires three structures (a corotron generator, insulator and counter electrode) to be carefully aligned in a support frame. All of the above-mentioned references are incorporated herein by reference.

Accordingly, a one-piece planar scorotron is disclosed that includes a resistive comb-like pattern on a slotted rigid, planar dielectric support with the comb-like pattern extending to the edge(s) of one or more slots through the support. An electrode is positioned on the underside of the support for charge leveling purposes and creating a scorotron that has high current capability and exhibits high efficiencies, up to about 50%.

The foregoing and other features of the instant invention will be more aparent from a further reading of the specifications, claims and from the drawing in which:

For a general understanding of the features of the present invention, reference is had to the drawings. In the drawings, like reference numerals have been used throughout to designate identical elements.

Figure 1:
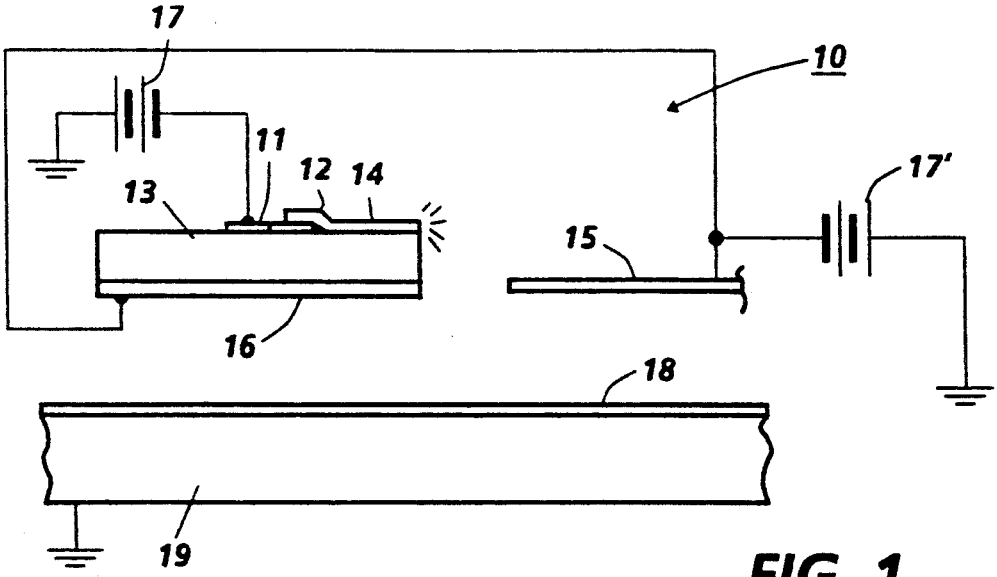
FIG. 1 (Prior Art)
FIG. 1 is a side view of a prior art flat corona device.

Present slit type scorotrons require precise alignment of at least three parts in a support frame. For example, the charging unit in U.S. Pat. No. 4,963,738 requires exact alignment of the charging elements 14, the insulator element 13 and the reference electrode 16. Electrode 15 cooperates with and is positioned adjacent to reference electrode 16 in order to form a slit through which ions are emitted. The device includes a flat scorotron 10 positioned in a horizontal plane above a charge retentive surface 18 supported on a grounded conductor 19 and a high voltage supply 17 is connected to buss bar 11 which in turn, is connected to a comb-like member 12 having coronode lines 14. Electrode 15 and reference electrode 16 are used for potential leveling.

Figure 2:
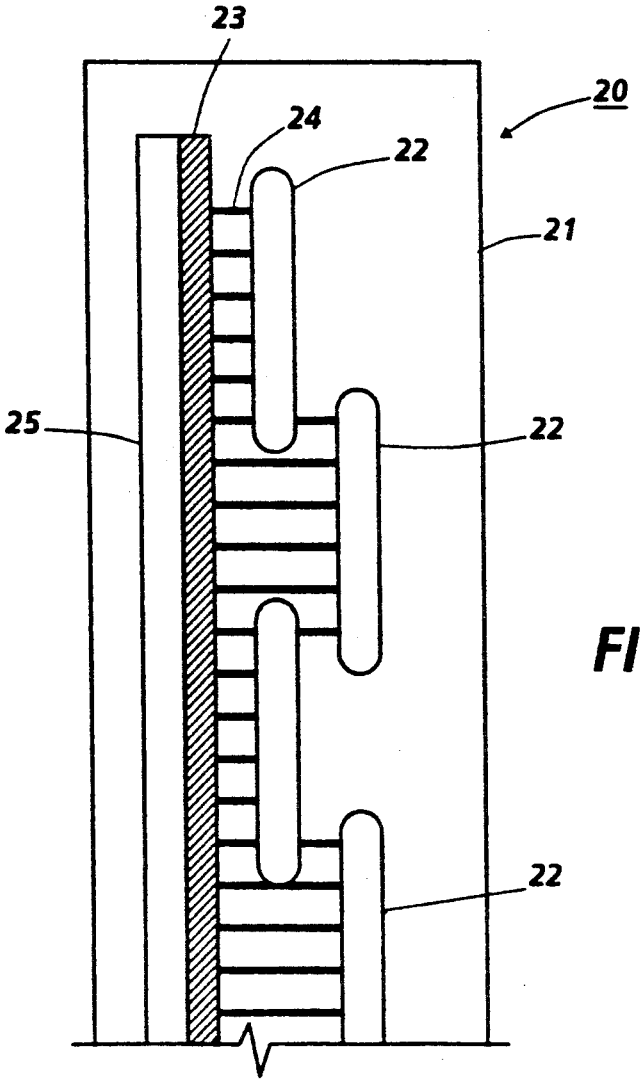
FIG. 2 is a plan view of an embodiment of the scorotron charging device of the present invention.
Figure 2A:
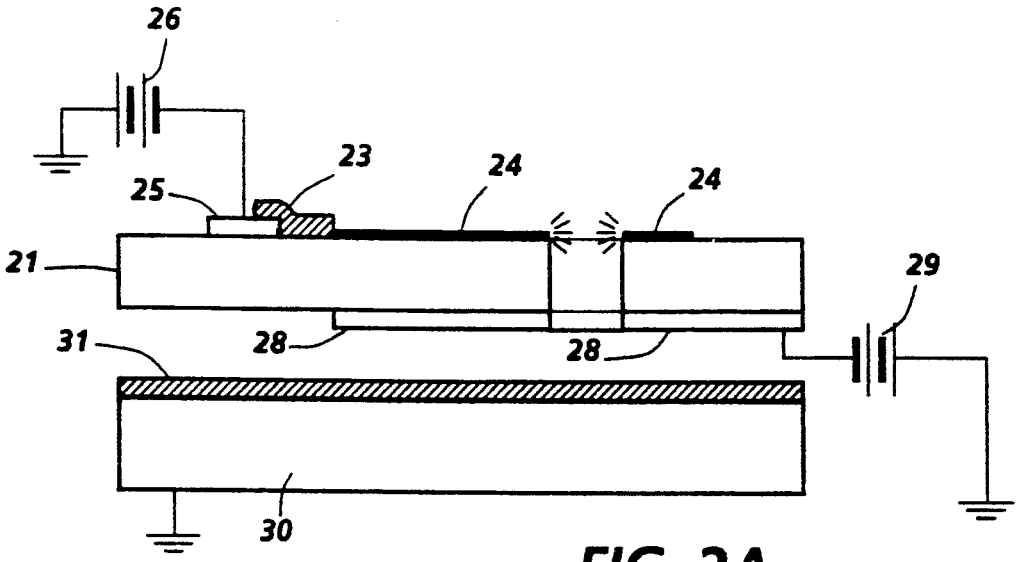
FIG. 2A is a side view of the scorotron charging device of FIG. 2.

The need for precise alignment of parts of a charging device is eliminated with use of the scorotron charging device 20 of FIGS. 2 and 2A. The rigid, one-piece, slotted scorotron 20 of the present invention comprises a substrate of a thin planar piece of alumina 21 with a ruthenium comb-like pattern 24 on one side, and a solid conductor 28 on the opposite side. Alumina substrate 21 has machined, staggered slots 22, e.g., formed by the use of lasers, therein that form a series of slits that allow ion flow. Each slot serves the function of the slit in U.S. Pat. No. 4,963,738, i.e., the terminated ruthenium tips of fingers 24 are the corona source, and the solid metal electrode 28 provides the pumping fringe fields and the reference potential. This planar design has the advantage over prior slit type charging devices in that no alignment of parts is required, no support frame is needed which reduces the size of the scorotron and the robustness of charger 20 makes it easy to install in a machine and easy to clean.

With further reference to FIGS. 2 and 2A, planar ion source 20 includes a high voltage, e.g., 5000 kV, at 26 connected to buss bar 25 which is electrically connected to comb-like fingers 24 through an overlapping resistor member 23 that includes ruthenium oxide in a ceramic or glass binder, all of which are supported on the top surface of an alumina substrate 21. Comb-like fingers 24 are positioned on approximately 7 to 60 mil centers. A reference electrode 28 is positioned on the bottom surface of insulator substrate 21 for potential leveling purposes and has a low voltage, e.g., −1000 kV applied to it from energy source 29. The preferred coronode is ruthenium glass, screen printed and fixed on the corona resistant substrate 21, such as, alumina, high temperature glass or ceramic matter. For charging purposes, scorotron 20 is positioned above a charge retentive surface 31 which is mounted on a grounded conductive support member 30 and moves in a direction orthogonal to the slots. Substrate 21 has staggered slots 22 that allow ion flow from ends or tips of fingers 24 to the surface of receptor 31. A unique aspect of this invention is the extension of fingers 24 to the edges of slots 22. Alumina support 21 separates the tips of fingers 24 from reference electrode 28 with its preferable thickness of about 0.5 mm (0.025"), however, the thickness can range from about 0.010 to about 0.100". The width of each slot is about 1 mm. A negative voltage of −5000 V D.C. is applied from high voltage source 26 to buss bar 25 contacting overlapping resistor member 23, and since each tip of fingers 24 is on insulating substrate 21, they act as stand alone resistors. The high resistance finger 24 limits arcing currents, and also serves to make corona current output more uniform, since the drop in potential between the buss bar and the tips of the fingers is the product of the current and resistance of each finger. The tips can be about 0.003 to about 0.125" width, but are preferably about 0.003" wide and positioned approximately on 7 mil centers. With an insulating layer covering and protecting part of reference electrode 28, charger unit 20 can be made to make contact with the surface to be charged.

Figure 3:
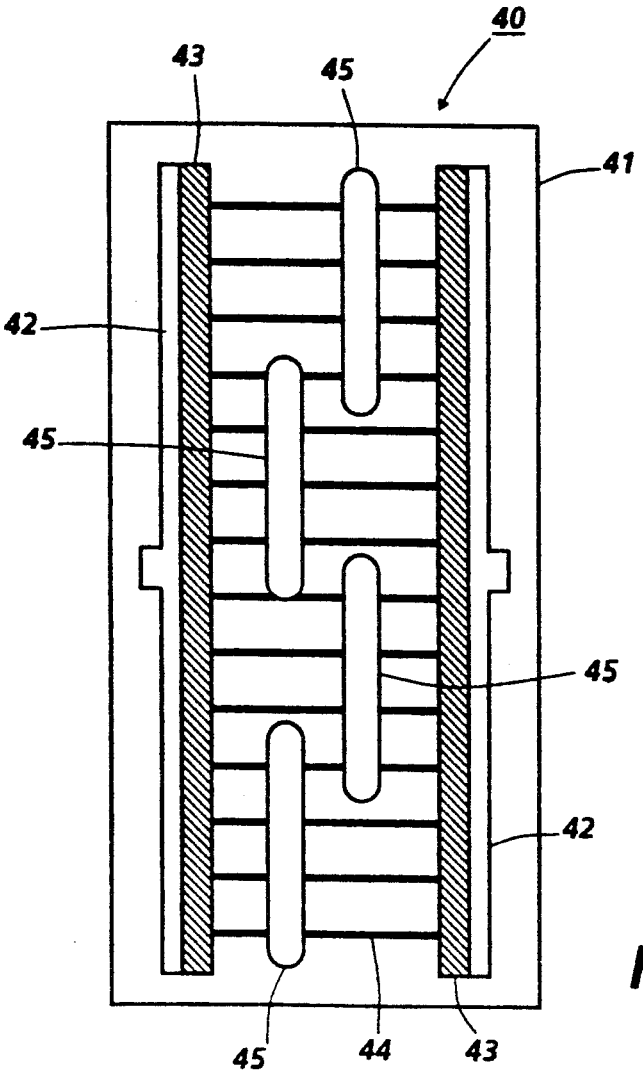
FIGS. 3 and 3A are plan views of alternate embodiments of the scorotron charging device of the present invention showing dual buss bars.
Figure 3A:
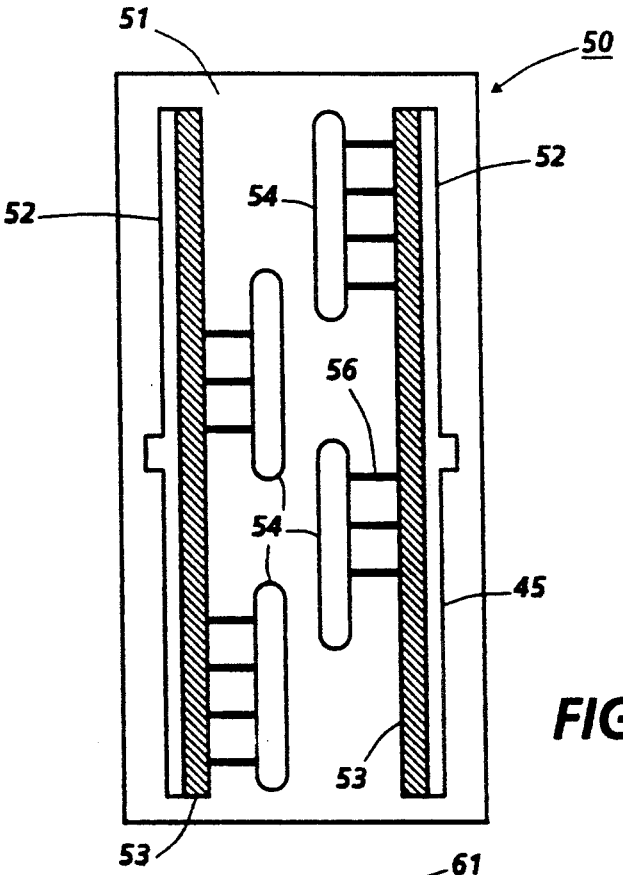
Figure 3B:
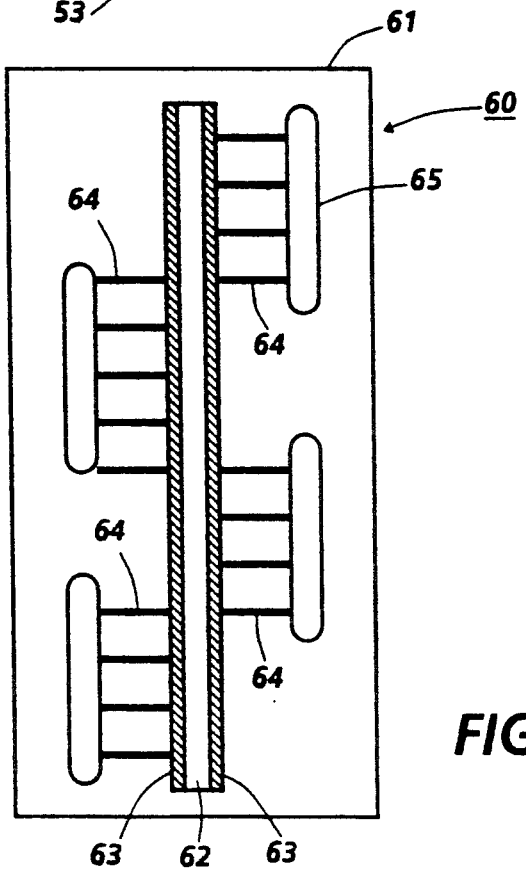
FIG. 3B is a plan view of another embodiment of the scorotron charging device of the present invention showing a center buss bar.

As shown in FIGS. 3–3B, alternative slot patterns and shapes may be employed in alumina support 21, including diagonal or zig-zag slots. The walls of the slots need not be cut parallel, but may be angled. Symmetry is a part of scorotron devices of FIGS. 3, 3A and 3B which show scorotrons with dual buss bars in FIGS. 3 and 3A and a single center located buss bar in FIG. 3B. The planar scorotron 40 of FIG. 3 includes a substrate 41 with identical parallel bus bars 42 on opposite sides of its top surface that are connected to identical resistive members 43 having lead lines 44 therefrom projecting to the edges of slots 45 in the substrate 41. An alternative embodiment of a planar ion source is 50 of FIG. 3A which comprises a support substrate 51, dual buss bars 52, dual resistive members 53 and comb-like lines 56 extending to staggered slots 54 culminating with tips thereof at the edges of the slots. Lines 56 extend to only one side of respective slots and alternately extending from each side of the support structure. FIG. 3B discloses a scorotron device 60 that includes a center buss bar 62 mounted on a support substrate 61. Resistive members 63 are positioned on opposite sides of the buss bar and have lines 64 leading therefrom to the edge slots 65 staggered on opposite sides of the support structure.

It should now be apparent that a novel scorotron charging device is disclosed in which the coronode consists of comb-like fingers extending to the edges of staggered slots in a rigid, planar dielectric support substrate. Leveling electrode(s) are positioned on the bottom of the substrate. The essential and distinguishing feature of this charging unit is that the unit is in one-piece and allows field lines to pass through and emerge from staggered slots therein, creating a scorotron having high efficiency and current capability up to about 50%. The resistive fingers make the unit self-limiting for coronode current flow. Also, this scorotron charging unit is suitable for use as a transfer or detack unit in a copier or printer or as an ionographic source.

While this invention has been described with reference to the structure disclosed herein, they are not confined to the details set forth and are intended to cover modifications and changes that may come within the spirit of the invention and scope of the claims.

What is claimed is:

1. A single piece, planar, integral scorotron DC charging device that applies a uniform charge to a charge retentive surface, comprising:

a dielectric support substrate, said dielectric support substrate including at least two slots therein;

comb shaped corona producing means with teeth-like lines positioned on one side of and extending to an edge of said dielectric support substrate slot and produce corona at said edge;

solid conductor means positioned on the other side of said dielectric support substrate;

means for applying a low voltage to said solid conductor means; and high voltage means connected to said corona producing means for applying sufficient voltage to said corona producing means that corona ions are emitted from said corona producing means at said edge of said dielectric support substrate.

2. The scorotron charging device of claim 1, wherein said slots are staggered.

3. The scorotron charging device of claim 2, wherein the surface of said solid conductor means that is adjacent to the charge retentive surface includes a partial insulative covering means in order to allow the charging device to be placed in direct contact with the charge retentive surface.

4. The scorotron charging device of claim 3, wherein said support substrate is made of alumina.

5. The scorotron charging device of claim 1, wherein said teeth-like lines of said comb shaped corona producing means are positioned on centers of approximately 7 to 60 mils.

6. The scorotron charging device of claim 5, wherein said teeth-like lines of said comb shaped corona producing means are about 0.003 to about 0.125" in width.

7. The scorotron charging device of claim 6, wherein said dielectric support substrate has a thickness of about 0.010" to about 0.100", but preferably about 0.025".

8. The scorotron charging device of claim 7, wherein said slots in said dielectric support substrate have a width of about 1 mm.

9. A scorotron DC charging unit that applies a uniform charge to a charge retentive surface, comprising:

a corona resistant dielectric support substrate having a top and bottom surface, said dielectric support substrate including at least two slots extending therethrough;

ruthenium oxide in a glass or ceramic binder corona producing means positioned on the top surface of said dielectric support substrate for producing corona at edge(s) of said at least two slots;

reference electrode means positioned on the bottom surface of said dielectric support substrate for controlling the charge level placed on the charge retentive surface by said corona producing means;

means for applying a low voltage to said reference electrode; and high voltage means connected to said corona producing means for supplying sufficient voltage to said corona producing means that ions are emitted from said corona producing means at said edges of said dielectric support substrate.

10. The scorotron charging device of claim 9, wherein said one or more slots are staggered.

11. The scorotron charging unit of claim 10, wherein the surface of said reference electrode that is adjacent to the charge retentive surface includes a partial insulative covering means in order to allow the charging unit to be places in direct contact with the charge retentive surface.

12. The scorotron charging unit of claim 11, wherein said support substrate is made of alumina.

13. The scorotron charging unit of claim 9, wherein said corona producing means is comb shaped with teeth-like lines positioned on one side of and extending to the edge(s) of said one or more slots in said dielectric support substrate.

14. The scorotron charging unit of claim 13, wherein said teeth-like lines of said comb shaped corona producing means are positioned on approximately 7 mil centers.

15. The scorotron charging unit of claim 14, wherein said teeth-like lines of said comb shaped corona producing means are about 0.003 to about 0.125" in width.

16. The scorotron charging unit of claim 15, wherein said dielectric support substrate has a thickness of about 0.025".

17. The scorotron charging unit of claim 16, wherein said one or more slots in said dielectric support substrate have a width of about 1 mm.

18. The scorotron charging unit of claim 9, wherein said charging unit is planar in configuration.

19. In a printing apparatus that places page image information onto copy sheets and including a DC charging unit for charging a charge retentive surface, the improvement of said charging unit, comprising: a corona resistant dielectric support substrate having a top and bottom surface, said dielectric support substrate including at least two slots extending therethrough;

ruthenium oxide in a glass or ceramic binder corona producing means positioned on the top surface of said dielectric support substrate for producing corona at edge(s) of said at least two slots;

reference electrode means positioned on the bottom surface of said dielectric support substrate for controlling the charge level placed on the charge retentive surface by said corona producing means;

means for applying a low voltage to said reference electrode; and high voltage means connected to said corona producing means for supplying sufficient voltage to said corona producing means that ions are emitted from said corona producing means at said edges of said dielectric support substrate.

20. The scorotron charging device of claim 19, wherein said one or more slots are staggered.

* * * * *